US007137525B2

(12) United States Patent
Gibney

(10) Patent No.: US 7,137,525 B2
(45) Date of Patent: Nov. 21, 2006

(54) SEALABLE CONTAINER LID

(76) Inventor: Timothy Gibney, 646 Oak St., Santa Rosa, CA (US) 95404

( * ) Notice: Subject to any disclaimer, the term of this patent is extended or adjusted under 35 U.S.C. 154(b) by 60 days.

(21) Appl. No.: 10/689,909

(22) Filed: Oct. 21, 2003

(65) Prior Publication Data

US 2005/0056651 A1 Mar. 17, 2005

Related U.S. Application Data

(60) Provisional application No. 60/419,985, filed on Oct. 21, 2002.

(51) Int. Cl.
*B65D 45/32* (2006.01)

(52) U.S. Cl. ..... 220/319; 206/15.3

(58) Field of Classification Search ..... 220/319–321, 220/315, 697, 679; 206/15.3, 15.2, 262.3, 206/362

See application file for complete search history.

(56) References Cited

U.S. PATENT DOCUMENTS 1,715,144 A * 5/1929 Paulson ..... 401/121
1,791,004 A * 2/1931 Shepard ..... 222/482
2,533,354 A * 12/1950 Comfort ..... 220/697
2,533,355 A * 12/1950 Comfort ..... 211/65
3,028,993 A * 4/1962 Muhlhoff ..... 220/321
3,291,295 A * 12/1966 Caligiuri ..... 206/15.3
3,561,637 A * 2/1971 McConnell ..... 220/320
3,664,544 A * 5/1972 Hammes ..... 220/320
4,295,508 A * 10/1981 Metzger ..... 220/320
4,533,044 A * 8/1985 Ban ..... 206/362
5,007,553 A * 4/1991 Curtis ..... 220/697
5,299,707 A * 4/1994 Stolzman ..... 220/321
5,350,065 A * 9/1994 Darrey ..... 206/373
5,363,870 A * 11/1994 Doyon ..... 134/184
D379,302 S * 5/1997 Rodman ..... D9/440
5,785,201 A * 7/1998 Bordner et al. ..... 220/321
6,041,919 A * 3/2000 Adams ..... 206/15.3
D461,609 S * 8/2002 Sands ..... D32/54
D467,398 S * 12/2002 Kohn ..... D32/53.1
6,983,862 B1 * 1/2006 Nottingham et al. ..... 222/109

* cited by examiner

*Primary Examiner*—Lien M. Ngo
(74) *Attorney, Agent, or Firm*—Jagtiani & Guttag

(57) ABSTRACT

A container lid that is easily sealed to prevent air and other environmental agents from infiltrating the covered container and its contents and to accommodate storage of tools such as paintbrushes or paint rollers. The lid includes a base and lip and a strap surrounding the lip to secure the position of the lid and prevent air from seeping into the container. The base of the lid can be a solid, smooth surface, or it can be configured with special features such as suction vents and pour spouts. The base further includes a hatch and slots for receiving and holding tools suspended from the lid into the container. The hatch includes features including a hatch cover, gasket, and hinge cover that prevent the passage of air into the container that when paired with the easily sealed lid on the container prevents air, pests, and other particles from ruining or contaminating the container contents or tools.

29 Claims, 12 Drawing Sheets

SEALABLE CONTAINER LID

CROSS-REFERENCE TO RELATED APPLICATIONS

This application claims priority to U.S. Provisional Application No. 60/419,985 filed on Oct. 21, 2002. The entire disclosure and contents of the above application is hereby incorporated by reference.

The present invention is directed generally to a container lid and specifically to a sealable container lid including a mechanism for securely holding tools such as painting and kitchen tools within the container when the lid is in place on the container.

BACKGROUND OF INVENTION

Containers for storing paint, food, and other substances have been in use for many years, and most such containers generally have lids that keep the contents from spilling out. Often containers need to be watertight or airtight or must be sealed to keep out contaminants, but such sealed containers are often difficult to open and close, and once the seal is broken, are not resealable and require tools to be opened or closed. A lid for a paint container, for example, is necessary to keep the paint from drying out. When not in use painting tools such as brushes and rollers must be paint-free in order to prevent the paint from drying in the brush. Many times painters must leave a painting job partially done, whether for a lunch break or an end of day work stoppage or other reason. Under these circumstances, the painter must cover the paint container and clean the painting tools so that they do not dry out and become unusable.

Covering and cleaning paint containers and tools is time a consuming and potentially messy procedure. Some painters have tried to overcome these problems by covering their brushes with plastic wrap or the like, however this procedure tends to be messy and does not always insure that the tools are completely covered, in which case they may dry out. Some painters store their brushes in a jar of solvent or water, in the case of water-based paints. This technique can cause the bristles to bend and become permanently deformed.

Paint container lids are also problematic in that when a can or bucket is closed while paint is in lid receiving rim of the can or bucket, the lid can become stuck to the point that it takes great effort to remove it. Even if there is no paint in the receiving rim, a tool such as a screwdriver is needed to pry open the lid. This process is time consuming and requires the user to have a screwdriver or other lever tool handy.

Finally, a person using traditional sealed containers can has no way to lock the lid of the can so that unauthorized persons can not easily get into the paint or other items that may be stored inside the container.

SUMMARY OF INVENTION

The present invention is directed to a container lid that is easily sealed to prevent air and other environmental agents from infiltrating the covered container. The lid includes a base and lip, and a strap surrounding the lip that secures the position of the lid and prevents air from seeping into the container. The base of the lid can be a solid, smooth surface, or it can be configured with special features such as suction vents and pour spouts.

A further aspect of the invention is a base configuration including a hatch and slots for receiving and holding tools such as painting tools such as brushes and rollers, kitchen utensils such as spoons, or measuring utensils such as measuring cups or spoons suspended from the lid into the container. The hatch includes features including a hatch cover, gasket, and hinge cover that prevent the passage of air into the container that when paired with the easily sealed lid on the container prevents air, pests, allergens, and other particles from infiltrating the contents of the container.

DETAILED DESCRIPTION OF INVENTION

Figure 1A:
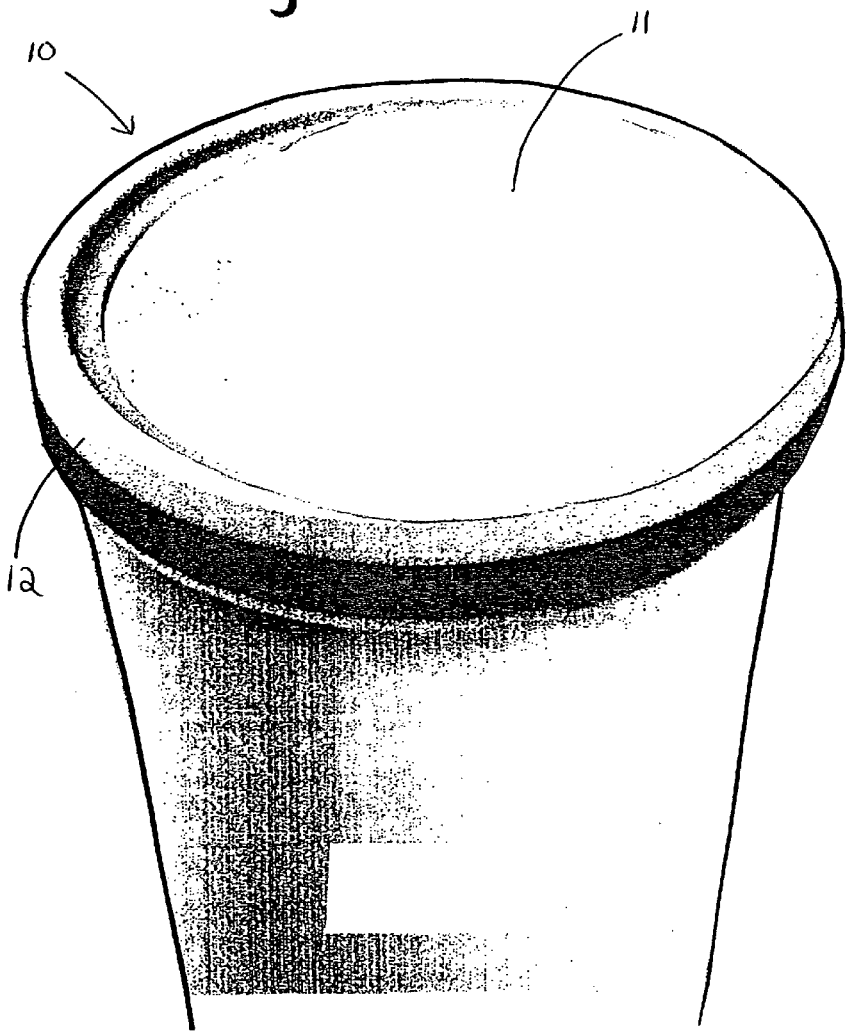
FIG. 1A is a schematic view of the lid with sealing mechanism.

The lid of the present invention can be attached to any container having a size and shape corresponding to the lid. For the purposes of the present description, the lid is shown as a circular cover for a cylindrical container, but the novel features described herein can correspond to a lid of any reasonable size and shape. In FIG. 1A, lid 10 includes a base 11, which covers the container opening, and a lip 12, which envelops the container rim when the lid is secured in place on the container. The lip 12 can be a sealed lip or an unsealed lip. A sealed lip configuration initially fits securely around the rim of the container to form a seal thereby preventing air from seeping through the lid, while an unsealed lip configuration simply fits loosely over the perimeter of the rim of the container. Lid 10 is preferably constructed of rigid material such as molded propylene while lip 12 is preferably constructed of resilient plastic material such as a vinyl or buna-N material; however, the preferences for material set forth herein do not limit the scope of the invention. Other suitable materials could be used by those skilled in the art. Lip 12 is preferably about one sixteenth of an inch thick and two inches in height, though the exact dimensions are not critical to the invention. The material used for lip 12 must resist migration of air from the outside environment to the inside of the container, and should preferably be resilient and easy to clean.

Figure 1B:
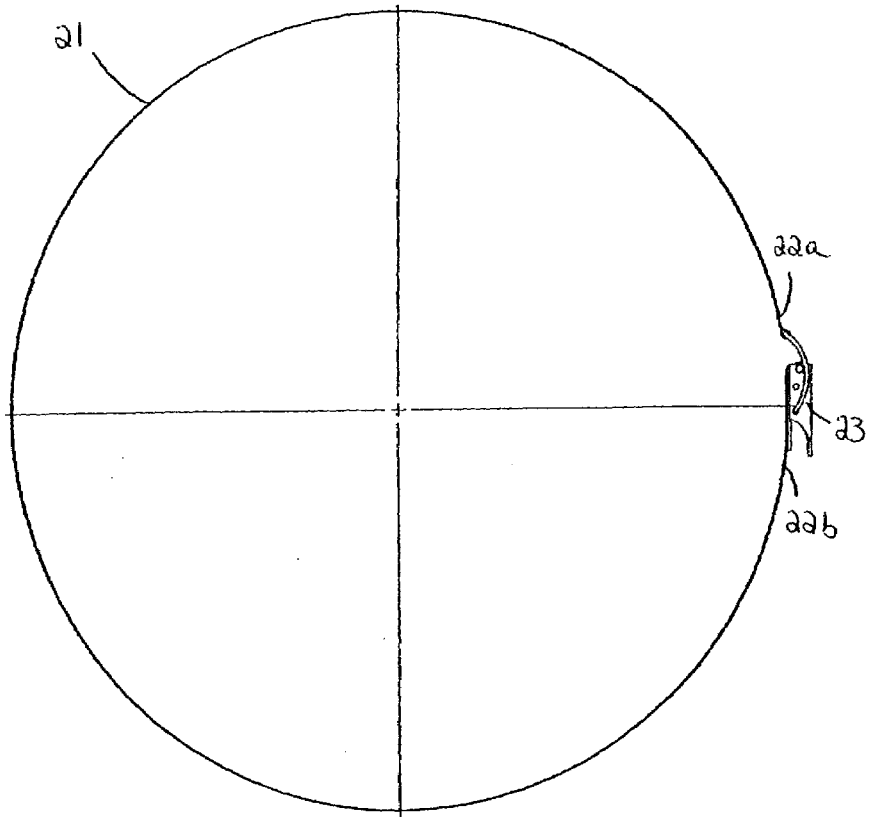
FIG. 1B is a schematic view of the strap with a toggle latch.

In order to further secure lid 10 to the container and to prevent the infiltration of air into the container, a flexible strap 21 having two ends 22*a* and 22*b* as shown in FIG. 1B surrounds lip 12 of FIG. 1A. Strap 21 is made of a flexible material such as nylon or pliable metal and terminates at each end with a fastening mechanism 23. Any fastening assembly known in the art can be used so that when the fastening mechanism 23 is in a locked position, strap 21 is pulled tightly around lip 12 into a cinched configuration. If lip 12 is an unsealed configuration, strap 21 is attached to base 10 and fits around lip 12. Upon closing of the fastening mechanism of strap 21, lip 12 compresses tightly around container. In a preferred embodiment, a lining lines the side of lip 12 that engages the container rim to form a more secure seal when compressed. If lip 12 is a sealed configuration, strap 21 is held onto lip 12 by a holding mechanism 25 which can include a plurality of loops 25 attached to lip 12, a tube attached to lip 12, or lip 12 itself. Strap 21 is inserted through said holding mechanism 25 thereby suspending the strap from lip 12 when the strap is not in a closed configuration. In the preferred embodiment, wherein lip 12 serves as the holding mechanism, lip 12 is a flexible, hollow nylon-type material, and strap 21 is inserted into the hollow area of lip 12. When strap 21 is tightened by fastening assembly 23, the lip 12 is drawn under the rim or tightly against the side of the container thereby creating a water-tight seal. In a preferred embodiment, a toggle latch is used as the fastening assembly, however hook and loop fasteners or buckles are also effective. A hasp 24 can protrude from strap 21 thereby allowing a lock to be inserted.

Figure 2:
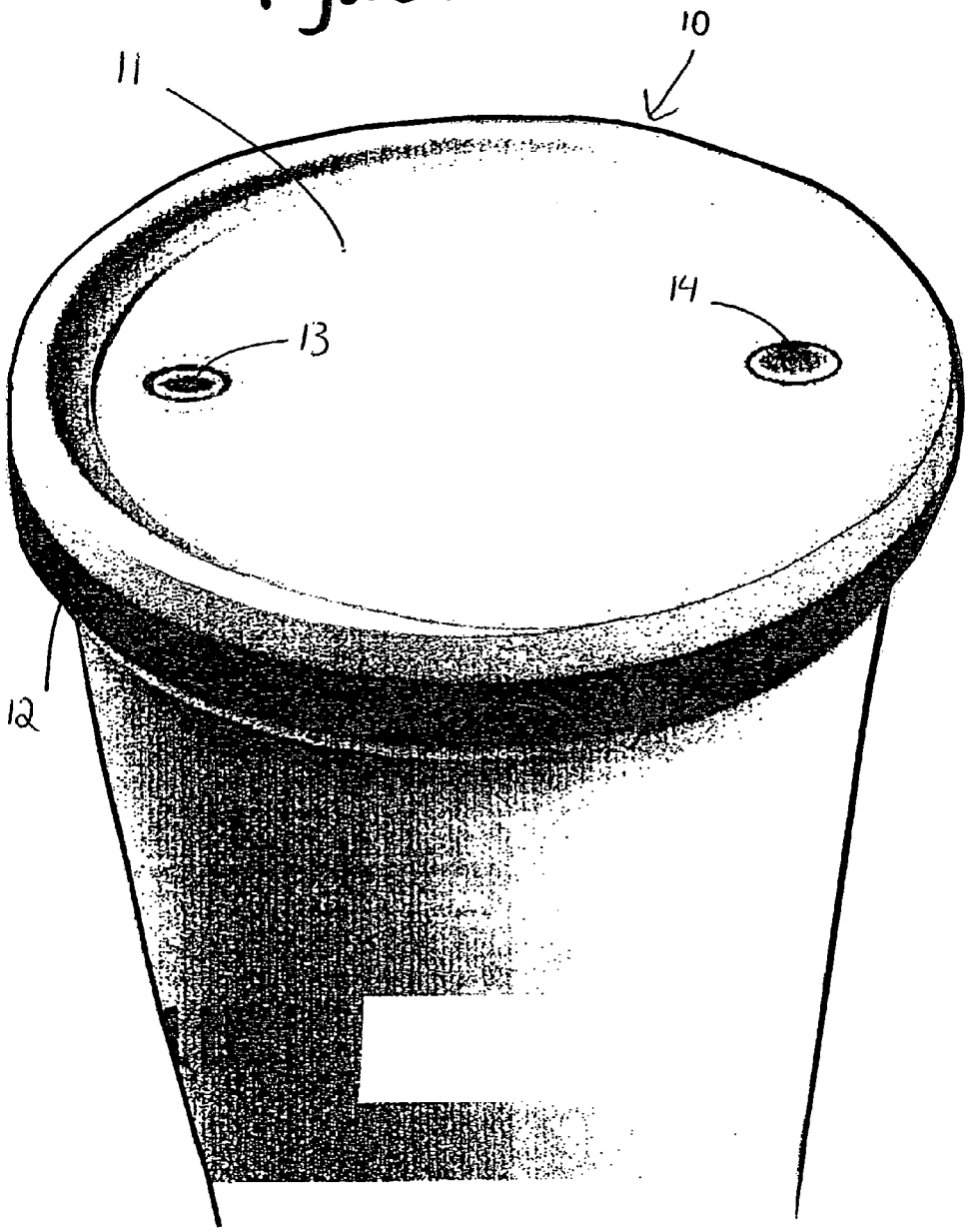
FIG. 2 is a schematic view of the sealed lid having a suction vent and pressure release valve.
Figure 3:
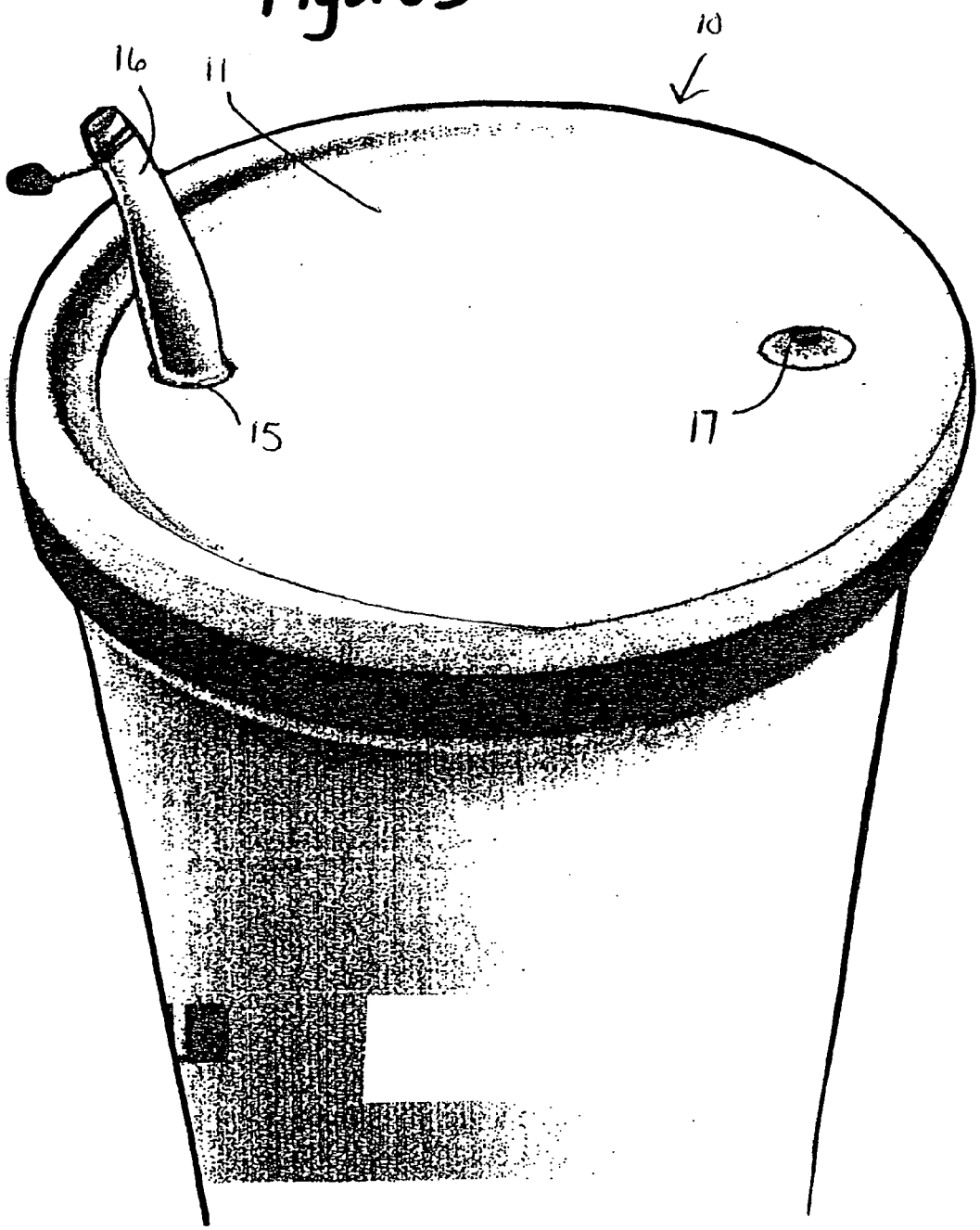
FIG. 3 is a schematic view of the sealed lid having a pour spout.

Base 11 of lid 10 can be a solid surface or can be configured to have special features. As shown in FIG. 2, base 11 can include a suction vent 13 and a pressure release valve 14. Suction vent 13 allows air to be removed from the container after the lid is in place thereby creating a vacuum-type environment inside the container. Pressure release valve 14 releases the vacuum created by the suction vent. As shown in FIG. 3, base 11 can also. include an opening 15 for receiving a pour spout 16. When the contents of the container need to be poured out, the pour spout 16 is inserted into opening 16 and when the pour spout is not needed, the opening 15 is covered with a cap. In order to reduce splashes when using pour spout 16, base 11 also includes and air vent 17. The lid of the present invention can be used to securely cover and seal a wide variety of containers, including but not limited to food storage containers and paint containers.

In a preferred embodiment, lid 10 is configured with a hatch to hold tools such as paintbrushes or rollers suspended from lid 10 within a sealed container. Other tools that could be suspended from the lid include kitchen utensils and measuring utensils. For simplicity of description, painting tools will be used as the primary example for describing the invention. The present invention is not limited to the tools described herein, but could be used to suspend any tool useful to one in the relevant art.

Figure 4A:
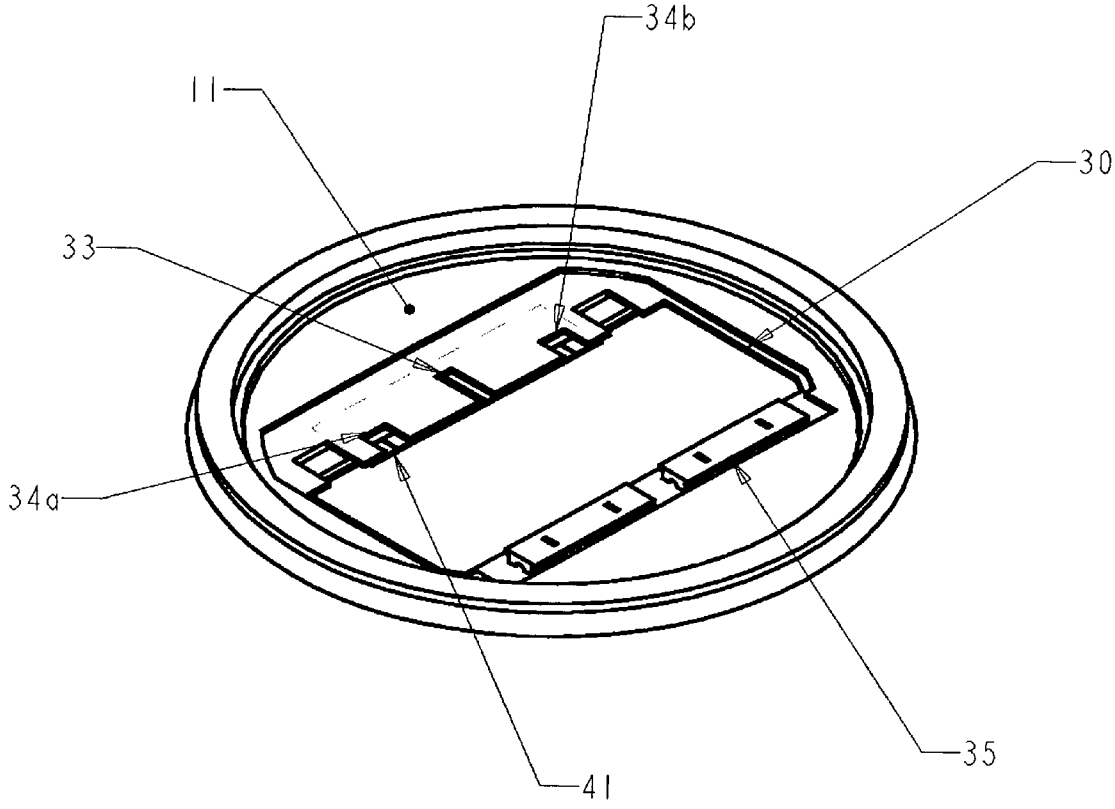
FIG. 4 is a schematic view of the lid showing the base having a hatch with slots and a hinge on the periphery.
Figure 4B:
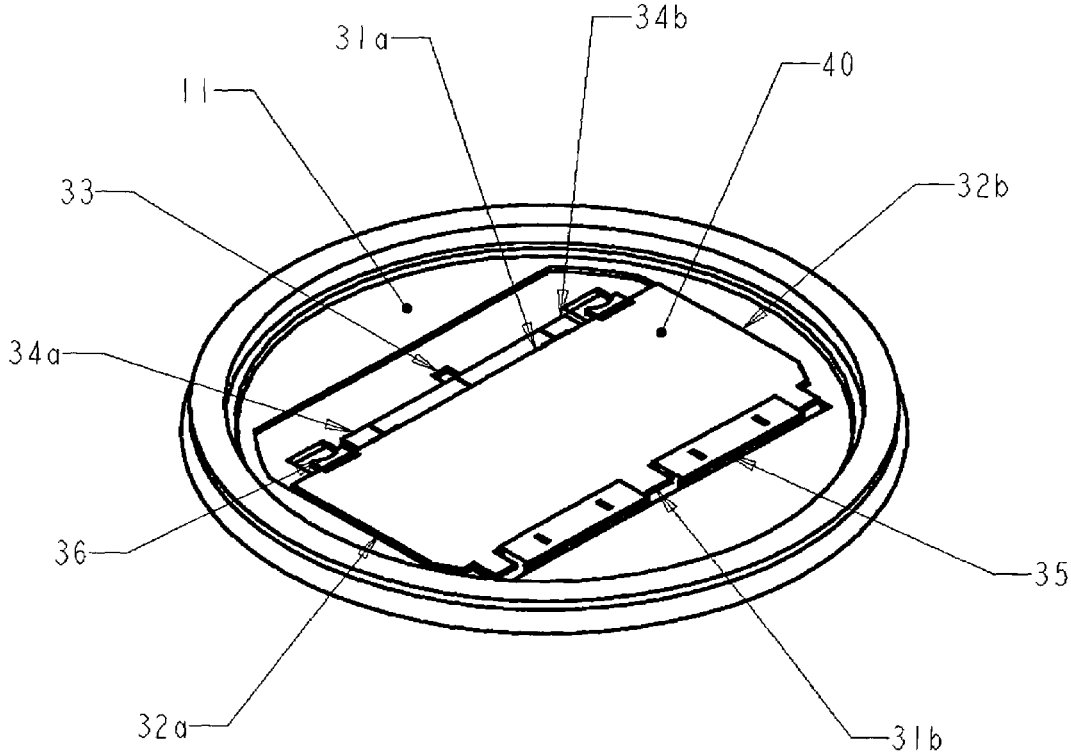
Figure 5:
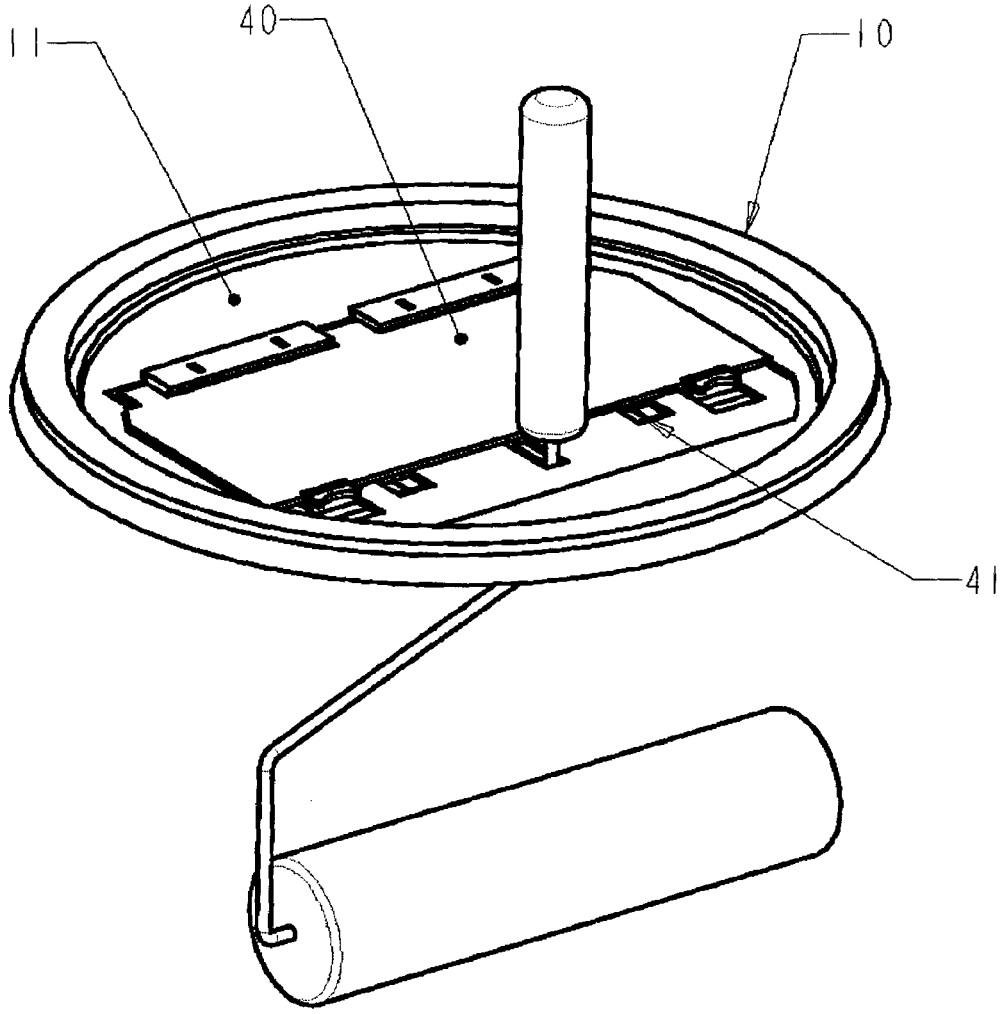
FIG. 5 is a schematic view of the lid showing a paint roller suspended in a slot.
Figure 7:
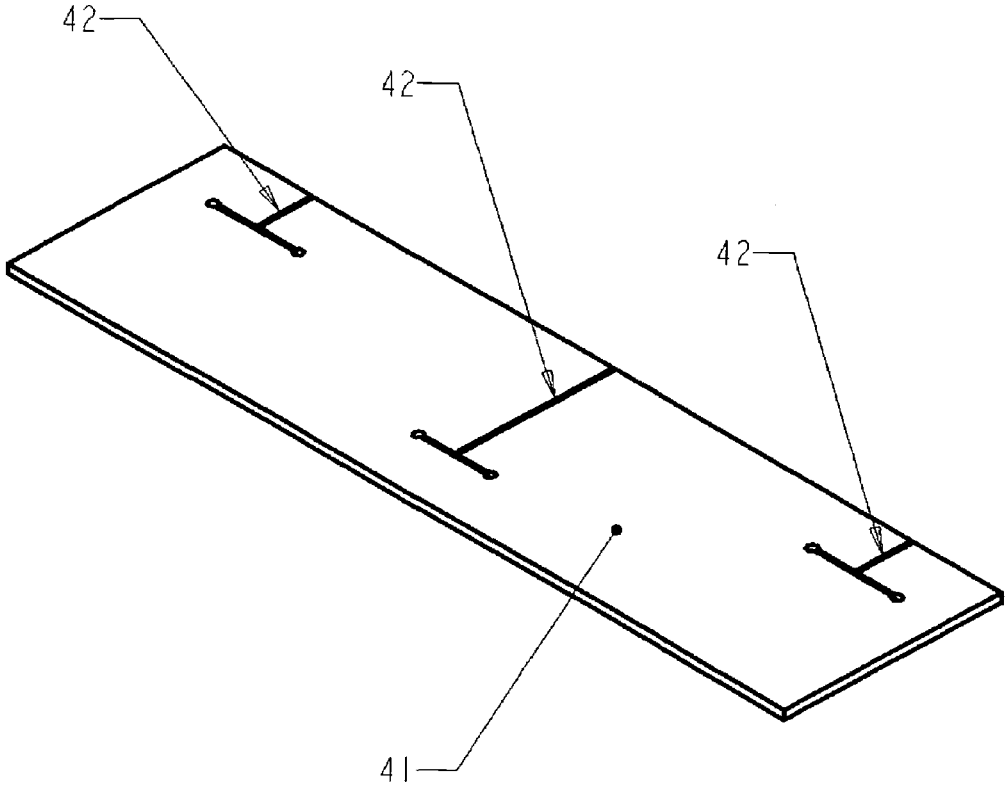
FIG. 7 is a schematic view of the gasket that fits under the slotted side of the lid of FIG. 4.

As shown in FIG. 4, within base 11 is a hatch 30 providing access into the covered container. Hatch 30 is preferably rectangular in shape having two parallel sides 31*a* and 31*b* and two parallel ends 32*a* and 32*b*. The periphery of side 31*a* includes at least one slot 33 for receiving the handle of a paint tool as shown in FIG. 5. FIG. 7 shows the preferred configuration of three slots 33, 34*a*, and 34*b* along the periphery of side 31*a*, which allows three tools to be suspended simultaneously from lid 10. Slots can vary depending on the intended use of the lid and there can be a variety of slots within one configuration. For example, slot 33 for receiving paint rollers is slightly longer and narrower than slots 34*a* and 34*b* for receiving paint brushes as illustrated in FIG. 7. The long, narrow slot better accommodates a paint roller handle while the short, wide slots better accommodate paintbrush handles. To hang a roller or brush in a slot, a painter simply lowers the roller or brush into the container through hatch 30 of lid 10 and then slides the handle into a slot.

Figure 6:
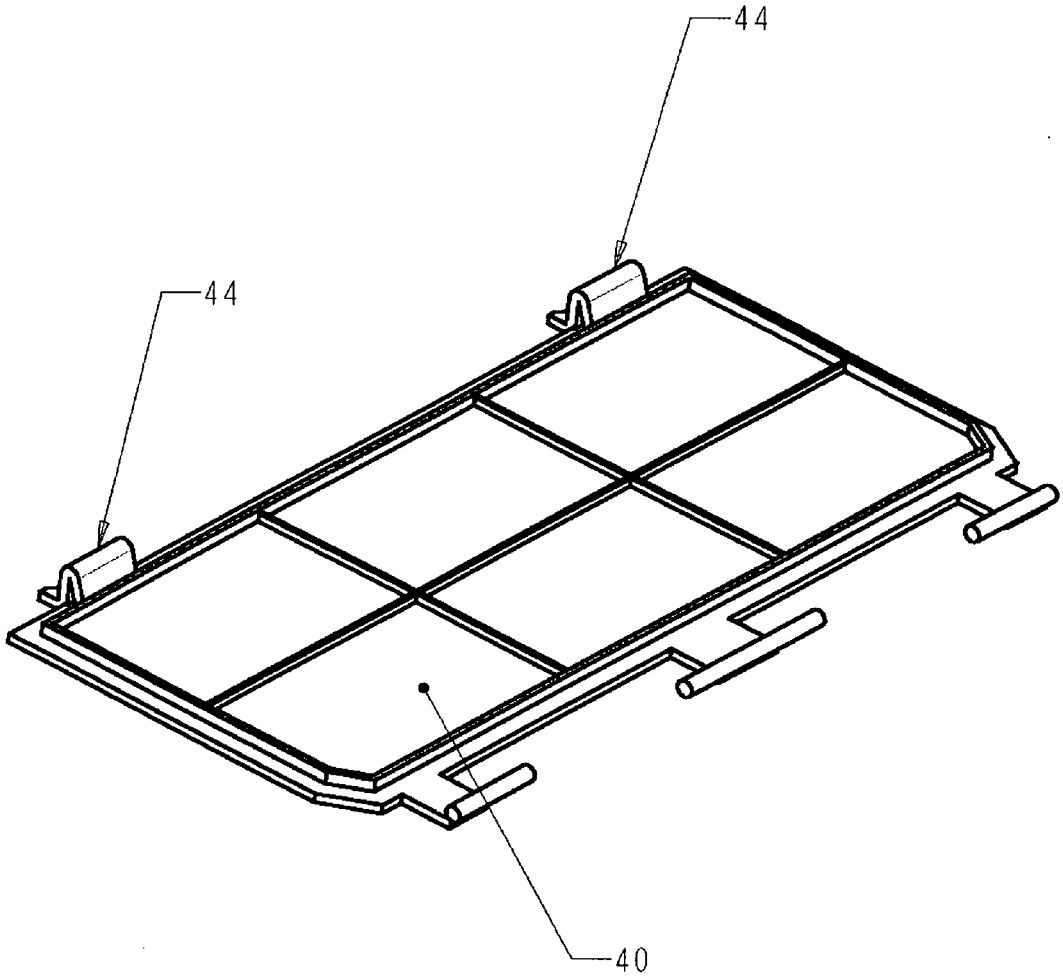
FIG. 6 is a schematic view of the hatch cover that coordinates with the hinge of FIG. 4 to cover the hatch of FIG. 4.
Figure 8:
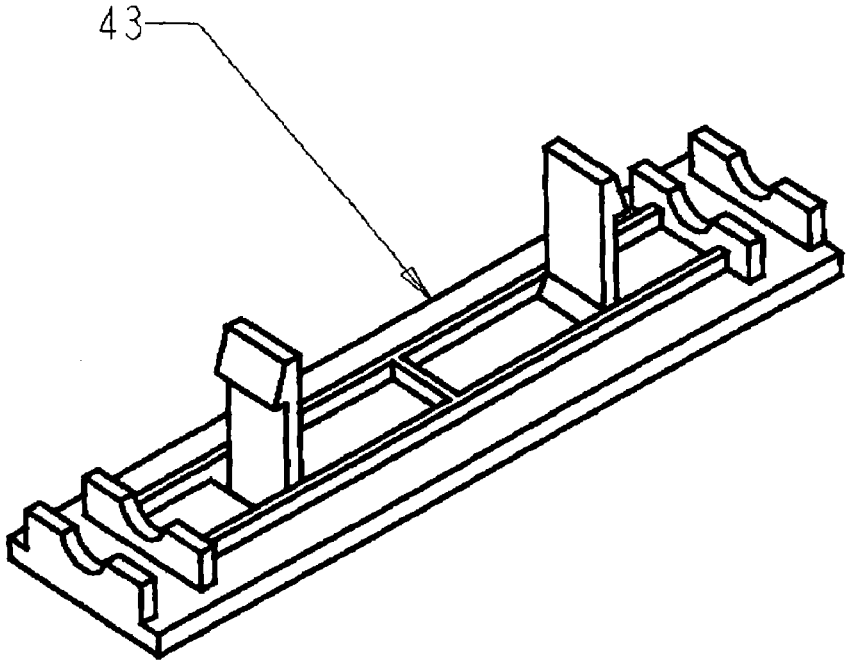
FIG. 8 is a schematic view of the hinge cover.
Figure 9:
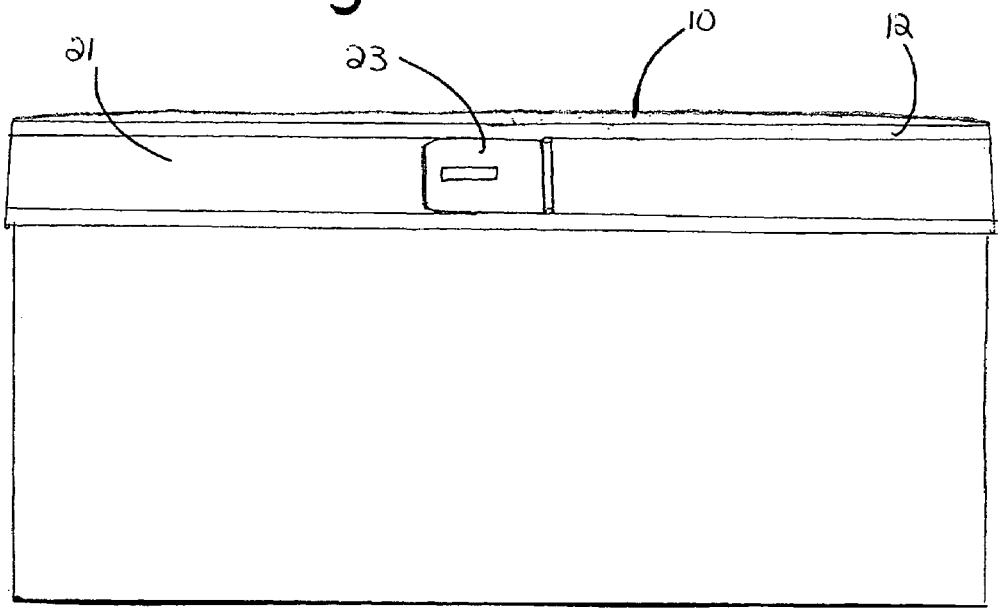
FIG. 9 is a schematic view of the lid in the unsealed lip configuration with a buckle fastener.
Figure 10:
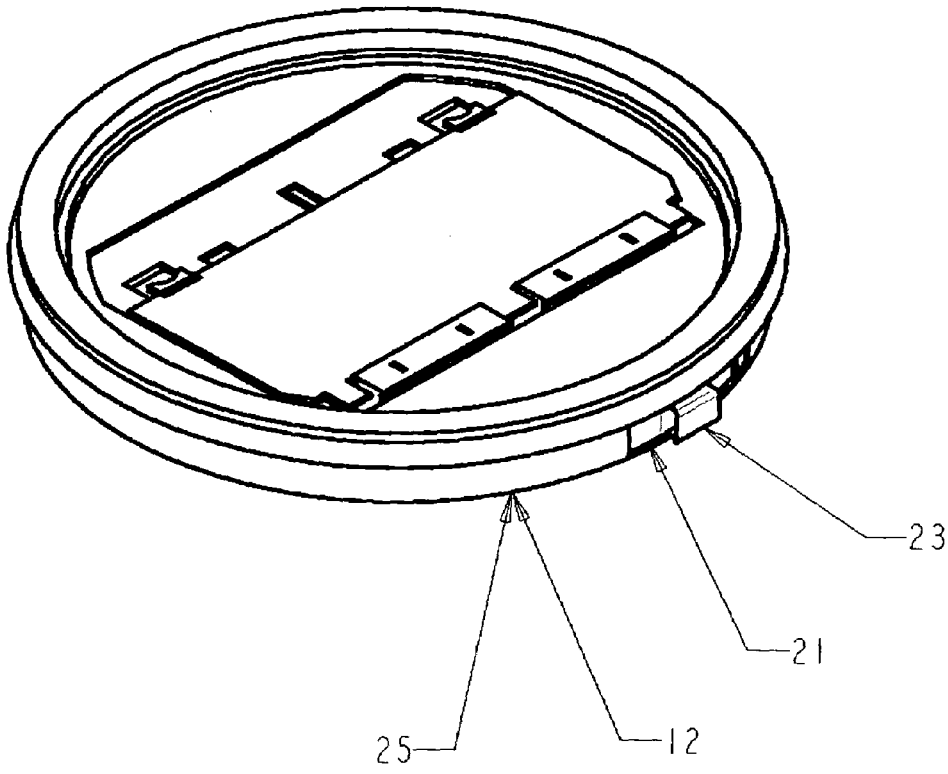
FIG. 10 is an embodiment showing hollow lip holding the strap.

The periphery of side 31*b* includes a hinge 35, which receives hatch cover 40 depicted in FIG. 6. Preferably, hinge cover 43, shown in FIG. 8, is attached over hinge 35 when hatch cover 40 is in the closed position to secure hatch cover 40 within hinge 35; however, a hinge assembly having a unitary hinge and cover could also be used. Hatch cover 40 is configured to securely cover and seal the entirety of hatch 30 when in the closed position. Accordingly, hatch cover 40 shown in FIG. 6 is rectangular in shape to correspond to hatch 30 shown in FIG. 4. Hatch cover 40 includes fastening mechanisms 44 that coordinate with fastening mechanisms 36 located on the periphery of side 31*a* as shown in FIG. 6, thereby securing hatch cover 40 in a closed position. Hinge cover 43 and hatch cover 40 can easily be removed from lid 10 allowing all moving parts to be cleaned to remove paint build up, soil, etc.

When in the closed position, hatch cover 40 does not cover slots 33, 34*a*, and 34*b* in order to accommodate tool handles extending up from said lid. In order to prevent air from entering the covered container and ruining or contaminating the contents and the tools, a gasket 41 is attached to the underside of lid 10 extending from the periphery of side 31*a* outward toward the lip 12 of lid 10 and away from hatch 30. The gasket 41 can be attached to the lid using any suitable adhesive known in the art. As shown in FIG. 7, gasket 41 includes at least one narrow slit 42. The number of slits a gasket contains corresponds directly to number of slots in the periphery of side 31*a*. Gasket 41 shown in FIG. 7 contains three slits 42 corresponding to slots 33, 34*a*, and 34*b* of FIG. 7. Gasket 41 is flexible so as to allow insertion of a tool handle into a slot and corresponding slit and envelope the handle once inserted thereby keeping air out of the covered container. When a handle is not inserted into a slot, slit 42 of gasket 41 remains in a closed configuration to keep air out.

The combination of elements of the present invention comes together to store painting tools in a substantially water-tight and air-tight manner within a paint container. To use the paint lid of the present invention, a container is covered with the lid having a base, lip, hatch, and strap previously described. Once the lid is in place covering the container opening, the flexible strap is cinched into a substantially water-tight configuration by closing the fastening mechanism and thus holding the lip tightly against the container. After the lid is sealed in place, at least one painting tool such as a paint brush or paint roller is inserted through said hatch and the handle of each tool is inserted within a slot and corresponding gasket slit along the first side of the hatch. The gasket snugly grips the tool handles to hold them in place and to further contribute to the air-tightness of the lid. The open hatch is then covered by closing the hatch cover over the hatch. The fastening mechanism on the hatch cover engages the corresponding fastening mechanism on the periphery of the hatch to hold the hatch cover in place. The hatch cover is simple to close as it functions as a door attached by hinges to the lid. The slots holding the painting tools hold the tools at a location that does not interfere with opening or closing the hatch cover. If desired, a hinge cover can be placed over the hatch cover hinge in order to further provide for an air-tight environment within the container.

The variety of lids described herein can be used independently to cover a container or in conjunction with one another to cover a single container for a single use. For example, a paint container can fitted with the suction vent/ pressure release lid while being stored, fitted with the pouring lid during a project, and fitted with the paint tool storage lid for temporary storage during a project. It is understood that various modifications may be made in the construction of the invention set forth above without departing form the spirit of the invention. Specific examples set forth in the description are not intended to limit the scope of the invention.

What is claimed is:

1. A paint container sealing lid comprising:

a base, said base having a first surface, a second surface, and a continuous edge;

a hatch within said base, said hatch having a first side, a second side, a first end, and as second end, wherein at least said first side includes at least one slot for holding at least one tool, said hatch having dimensions sufficient for receiving at least one tool;

a hatch cover covering said hatch, said hatch cover attached to said hatch by a hinge at said second side of said hatch;

a lip adjacently attached to said continuous edge, said lip having an indentation for enveloping a rim of said container;

a flexible strap proximal said lip, said strap having a first end and a second end;

a fastening mechanism attached to said first end and said second end of said strap;

wherein said fastening mechanism cinches said flexible strap into a water-tight configuration, said strap holding said lip against said container upon closing of said fastening mechanism.

2. The lid of claim 1, wherein said lip is a sealed lip.

3. The lid of claim 2 further comprising a holding mechanism wherein said holding mechanism holds said strap next to said sealed lip.

4. The lid of claim 3, wherein said holding mechanism is a series of loops attached to said sealed lip, said series of loops receiving said strap.

5. The lid of claim 3, wherein said holding mechanism is a tube attached to said sealed lip, said tube receiving said strap.

6. The lid of claim 3, wherein said holding mechanism is said sealed lip, said sealed lip being hollow and receiving said strap.

7. The lid of claim 1, wherein said lip is an unsealed lip.

8. The lid of claim 7, wherein said strap is attached to said base.

9. The lid of claim 1, wherein said base is comprised of a rigid material.

10. The lid of claim 1, wherein said lip is comprised a plastic material.

11. The lid of claim 1, wherein said strap is comprised of nylon.

12. The lid of claim 1, wherein said strap is comprised of metal.

13. The lid of claim 1, wherein said fastening mechanism is a toggle latch.

14. The lid of claim 1, wherein said fastening mechanism is a buckle.

15. The lid of claim 1, wherein said fastening mechanism is a hook and loop fastener.

16. The lid of claim 1, further comprising a hasp attached to said strap.

17. The lid of claim 1, further comprising a suction vent and pressure release valve within said base, wherein said suction vent allows air to be removed from said container to create a vacuum within said container and said pressure release valve releases said vacuum created by said suction vent.

18. The lid of claim 1, further comprising a pour opening and an air vent within said base.

19. The lid of claim 18, further comprising a pour spout fitting within said pour opening.

20. The lid of claim 1, wherein said at least one tool is a painting tool.

21. The lid of claim 1, wherein said at least one slot is three slots.

22. The lid of claim 1, further comprising a removable hinge cover.

23. The lid of claim 1, further comprising a fastening mechanism attached to said first side of said hatch and to a side of said hatch cover corresponding to said first side of said hatch, wherein said fastening mechanism coordinates to securely fasten said hatch cover over said hatch.

24. The lid of claim 1, wherein said hatch cover accommodates said at least one tool.

25. The lid of claim 1, further comprising a flexible gasket attached to said second surface of said base beneath said first side of said hatch.

26. The lid of claim 25, wherein said gasket includes at least one slit corresponding to each of said at least one slot of said first side of said hatch, wherein said at least one slit receives said at least tool preventing air from entering said container through said at least one slot in said hatch.

27. A method of storing a paintbrush or paint roller comprising:

sealing a container with a lid comprising:

a base, said base having a first surface, a second surface, and a continuous edge;

a lip adjacently attached to said continuous edge, said lip having an indentation for enveloping a rim of said container;

a flexible strap proximal said lip, said strap having a first end and a second end;

a fastening mechanism attached to said first and second end;

a hatch within said base, said hatch having a first side, a second side, a first end, and as second end, wherein at least said first side includes at least one slot for receiving at least one handle of a paintbrush or paint roller, said hatch having dimensions sufficient to receive an entire painting tool;

a hatch cover covering said hatch, said hatch cover including at least one opening corresponding to said at least one slot for accommodating said at least one handle of a paintbrush or paint roller;

a flexible gasket attached to said second surface of said base beneath said first side of said hatch, said gasket including at least one slit corresponding to said at least one slot of said first side of said hatch, wherein said at least one slit receives said at least one handle preventing air from entering said container through said at least one slot in said hatch;

cinching said flexible strap into a water-tight configuration, said strap holding said lip against said container upon closing of said fastening mechanism;

inserting at least paint brush or paint roller through said hatch and inserting at least one handle from said paint brush or paint roller within said at least one slot of said first side of said hatch and said corresponding at least one slit within said gasket; and closing said hatch cover over said hatch;

wherein, said at least one paintbrush or paint roller is suspended from said lid within said container; and wherein, said container is sealed in an air-tight configuration.

28. A paint container sealing lid comprising:

a base, said base having a first surface, a second surface, and a continuous edge;

a hatch within said base, said hatch having a first side, a second side, a first end, and as second end, wherein at least said first side includes at least one slot for holding at least one tool, said hatch having dimensions sufficient for receiving at least one tool;

a hatch cover covering said hatch;

a flexible gasket attached to said second surface of said base beneath said first side of said hatch;

a lip adjacently attached to said continuous edge, said lip having an indentation for enveloping a rim of said container;

a flexible strap proximal said lip, said strap having a first end and a second end;

a fastening mechanism attached to said first end and said second end of said strap;

wherein said fastening mechanism cinches said flexible strap into a water-tight configuration, said strap holding said lip against said container upon closing of said fastening mechanism.

29. The lid of claim 28, wherein said gasket includes at least one slit corresponding to each of said at least one slot of said first side of said hatch, wherein said at least one slit receives said at least one tool preventing air from entering said container through said at least one slot in said hatch.

* * * * *